US005577431A

United States Patent [19]

Küsters

[11] Patent Number: 5,577,431

[45] Date of Patent: Nov. 26, 1996

[54] EJECTION AND DISTRIBUTION OF SUBMUNITION

[75] Inventor: Manfred Küsters, Schliersee, Germany

[73] Assignee: Daimler-Benz Aerospace AG, München, Germany

[21] Appl. No.: 605,164

[22] Filed: Oct. 17, 1990

[30] Foreign Application Priority Data

Oct. 18, 1989 [DE] Germany ..... 39 34 751.6

[51] Int. Cl.[6] ..... F42B 12/58

[52] U.S. Cl. ..... 89/1.51; 102/393; 89/1.11

[58] Field of Search ..... 89/1.51, 1.11; 112/393, 489, 387, 475, 476, 306; 244/137.4

[56] References Cited

U.S. PATENT DOCUMENTS

| | | | |
|---|---|---|---|
| 3,517,584 | 6/1970 | Robinson et al. | 89/1.51 |
| 4,160,415 | 7/1979 | Cole | 102/475 |
| 4,172,407 | 10/1979 | Wentink | 102/489 |
| 4,417,520 | 11/1983 | Mamudal | 102/489 |
| 4,494,437 | 1/1985 | von Maydell | 89/1.51 |
| 4,522,356 | 6/1985 | Lair et al. | 102/489 |
| 4,711,178 | 12/1987 | Argyrakis | 102/387 |
| 4,750,423 | 6/1988 | Nagabhushan | 89/1.51 |
| 4,960,055 | 10/1990 | Dieval | 102/489 |
| 5,020,437 | 6/1991 | Rieger et al. | 102/489 |

*Primary Examiner*—Michael J. Carone
*Attorney, Agent, or Firm*—McGlew and Tuttle

[57] ABSTRACT

In a method for the ejection and distribution of submunition bodies to be ejected from a submunition carrier for combatting targets in a line, such as vehicle columns, the submunition carrier (3) comprises vertical ejecting tubes (3*a*) for the submunition bodies, which vertical ejecting tubes (3*a*) are directed downward as well as upward. Submunition bodies (7) which are connected with a wind sock for stabilization are ejected downward. The submunition bodies (9) which are to be ejected in an upward direction are connected with a parachute which is provided with at least one eccentric slot.

2 Claims, 2 Drawing Sheets

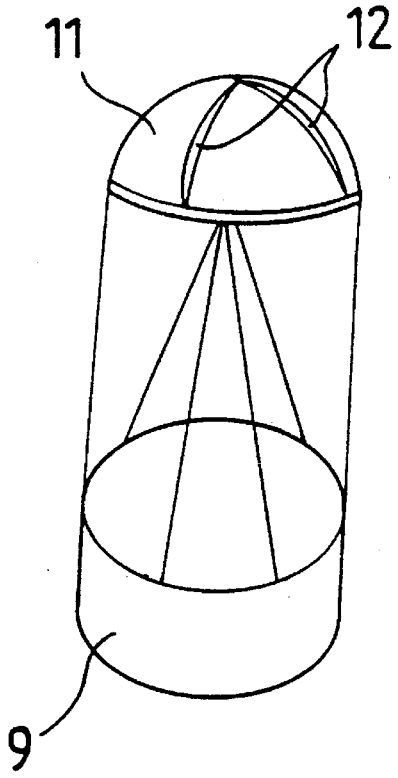
FIG. 2
FIG. 3
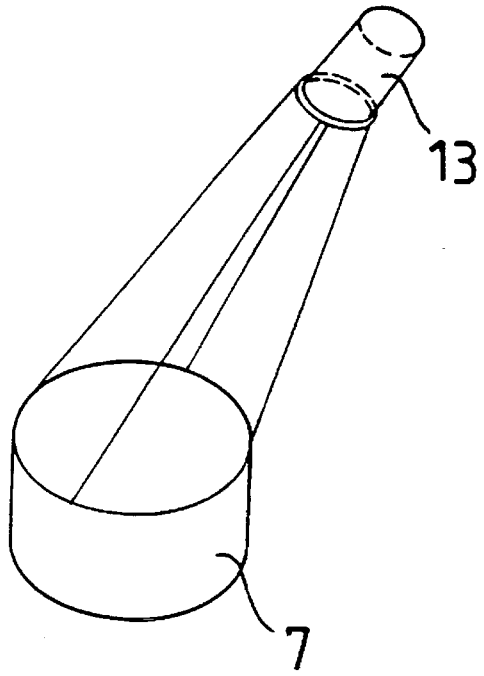

EJECTION AND DISTRIBUTION OF SUBMUNITION

The invention is directed to a method for ejecting and distributing submunition bodies to be ejected from submunition carriers for combatting targets in a line, e.g. vehicle columns, and to the submunition carrier and submunition bodies for the method.

Combatting targets in a line, such as vehicle or tank columns, is one of the chief tasks of an air force. Because of the large number of vehicles and the high vehicle density per surface area unit, submunition bodies to be ejected from submunition carriers would be best suited for combatting such targets. However, such known scattering systems cover target areas over large surface areas below the submunition carrier with diminished efficacy because they eject the submunition laterally. Accordingly, they are not suitable for effectively combatting targets in a line such as vehicle columns. The effort to maintain the previous method and to equip the submunition bodies to be ejected with the capability of target acquisition and maneuverability requires high costs.

The object of the invention is to eliminate these disadvantages and to suggest a method and submunition carrier with simple submunition bodies especially for combatting targets in a line.

The submunition bodies ejected according to the method, according to the invention, have a high accuracy of fire because of the high target density of columns. In contrast to known submunition carriers, the submunition used is provided, according to the invention, with ejecting tubes acting in an upward and downward direction, so that the targets can be attacked from above and below with two series of different submunition bodies. The submunition bodies to be ejected vertically downward out of the submunition carrier also work when they strike the target directly from above as well as when they fall on the ground and strike through the armor of the target from below as a mine. In order to attain a small elliptical target surface, these submunition bodies are connected with stabilizing bodies such as wind vanes or wind socks. The submunition bodies which are to be ejected upward are advisably provided with a parachute which unfolds immediately after ejection and with at least one eccentric slot. The submunition body accordingly glides down in a spiral-shaped manner and attains an elliptical target surface. When striking an armored vehicle directly, the explosive or shaped charge of the submunition body is triggered by a contact fuse, magnet fuse or similar sensor (e.g. explosive function sensor). When the submunition body falls on the ground, the ignition can be initiated via an acoustic sensor.

This method for attacking vehicle columns with two waves from a submunition carrier with submunition bodies acting in different directions is substantially more effective compared with such previously known methods of attack. The submunition bodies used require no special sensors for target guidance and target acquisition and can accordingly be produced inexpensively.

The invention is explained in more detail in the following by means of the drawing.

FIG. 2 shows a submunition body suspended at a slotted parachute; and

FIG. 3 shows a submunition body with attached wind sock.

Figure 1:
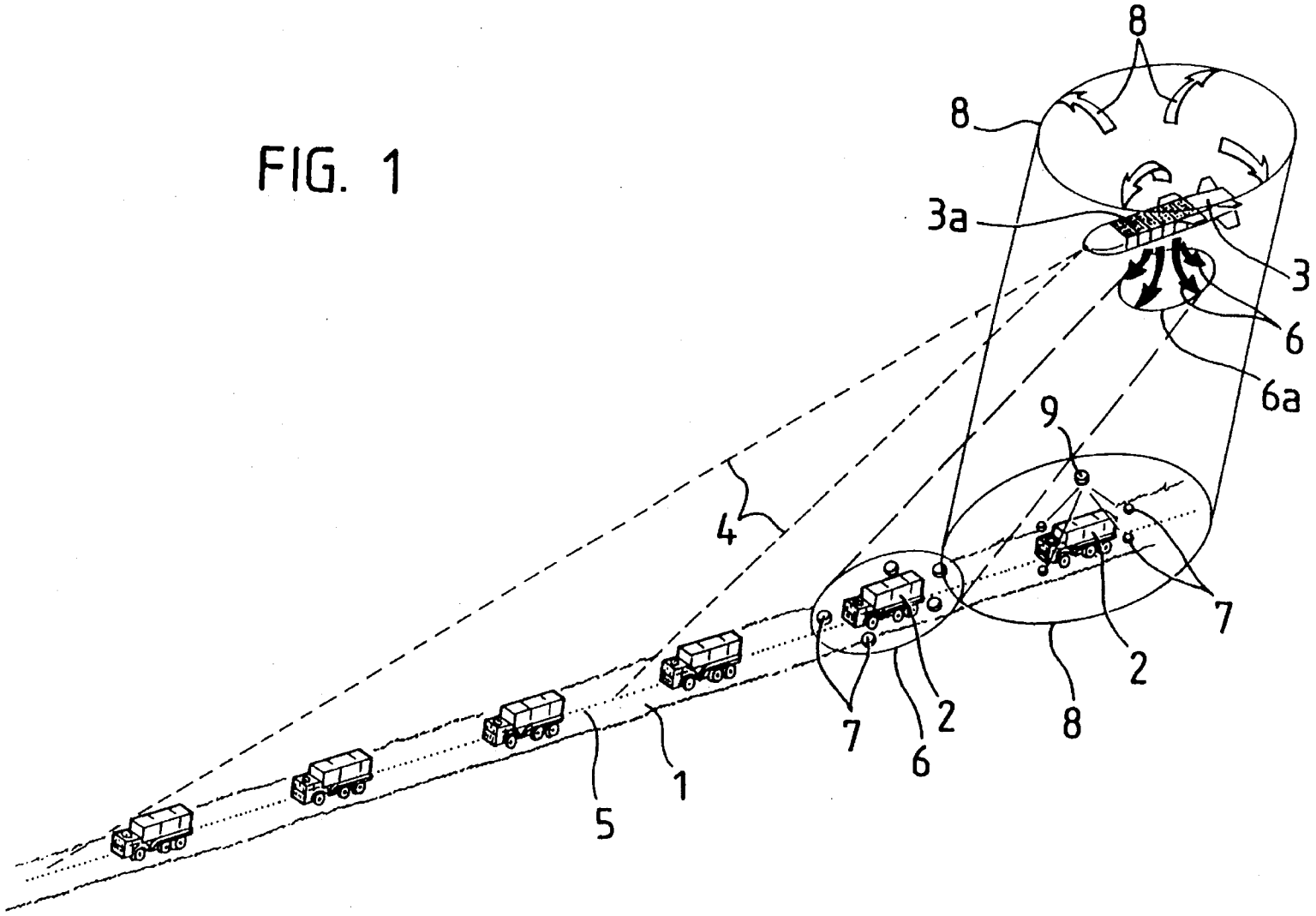
FIG. 1 shows a view of a method for combatting a vehicle column with submunition bodies.

Corresponding to FIG. 1, a column of vehicles 2 is located on a road 1. Above the road 1 is a submunition carrier 3 in target approach to the vehicles 2, which submunition carrier 3 was e.g. dropped by an airplane, not shown, or launched from the ground. The submunition carrier 3, which comprises vertically arranged ejecting tubes **3*a* directed downward as well as upward, is aligned exactly to a center line 5 of the vehicle path and accordingly to the vehicles 2 by means of the target sensors, e.g. infrared sensors, responding to the vehicles, which target sensors are characterized by lines of action 4. Arrows 6 show submunition bodies 7 which are ejected downward out of the submunition carrier 3 and fall diagonally on the road 1, where some submunition bodies 7 have already fallen around the vehicles 2, at an acute angle in an approximately elliptically defined surface area 6*a* due to the air resistance and due to a wind sock shown in the following with the aid of FIG. 3. Arrows 8 show the ejection direction of submunition bodies 9 which are ejected upward. The latter also fall within an approximately elliptically defined surface area 8*a* and preferably act on the vehicle 2 from above with the air of e.g. acoustic or explosive function sensors, as is shown by means of a submunition body 9**.

FIG. 2 shows one of the submunition bodies 9, which is to be ejected in an upward direction, in flight, wherein it hangs from a parachute 11. The parachute 11 has two eccentric slots 12 which cause a spiral flight of the submunition body. FIG. 3 shows a submunition body 7 in flight, wherein it is stabilized by a wind sock 13.

The submunition bodies work actively and passively, the effective direction is downward or upward corresponding to the sensor triggering. The uniqueness of the method consists in that the mobility of the targets is limited or eliminated with the submunition bodies 7 which are ejected in a downward direction and destruction is accomplished in every case in the effective range with the submunition bodies 9 which are ejected in an upward direction.

I claim:

1. Method of ejecting and distributing submunition bodies to be ejected from a submunition carrier for combatting targets in a line, e.g. vehicle columns, characterized by the following method steps:

aligning the submunition carrier, equipped with sensors for target acquisition, on the line of targets;

identifying the individual objects via road criteria e.g. by means of infrared sensors;

ejecting passive submunition bodies, e.g. mines, from the submunition carrier in a vertical downward direction;

ejecting active submunition bodies, e.g. shaped charge munition bodies, from the submunition carrier in an upward direction; and directing the passive and active submunition bodies on the individual objects of the line of targets.

2. Method according to claim 1, wherein effecting the ejection from the submunition carrier simultaneously in upward and downward directions.

* * * * *